US005275902A

United States Patent [19]

Takagi et al.

[11] Patent Number: 5,275,902

[45] Date of Patent: Jan. 4, 1994

[54] DEVELOPER COMPOSITION FOR ELECTROPHOTOGRAPHY

[75] Inventors: Masahiro Takagi; Yasuo Matsumura; Masaaki Usami, all of Minami Ashigara, Japan

[73] Assignee: Fuji Xerox Co., Ltd., Tokyo, Japan

[21] Appl. No.: 887,152

[22] Filed: May 22, 1992

Related U.S. Application Data

[63] Continuation-in-part of Ser. No. 836,385, Feb. 18, 1992, Pat. No. 5,256,511.

[30] Foreign Application Priority Data

| | | | |
|---|---|---|---|
| Feb. 20, 1991 | [JP] | Japan | 3-26276 |
| Feb. 20, 1991 | [JP] | Japan | 3-26277 |
| Feb. 25, 1991 | [JP] | Japan | 3-29816 |
| May 23, 1991 | [JP] | Japan | 3-118396 |

[51] Int. Cl.[5] ..... G03G 9/113

[52] U.S. Cl. ..... 430/108; 428/407

[58] Field of Search ..... 430/108; 428/407

[56] References Cited

U.S. PATENT DOCUMENTS

| | | | |
|---|---|---|---|
| 3,873,355 | 3/1975 | Queener et al. | 430/108 |
| 4,297,427 | 10/1981 | Williams et al. | 430/108 |
| 4,937,166 | 6/1990 | Creatura et al. | 430/108 |
| 5,075,158 | 12/1991 | Kouno et al. | 430/108 X |

FOREIGN PATENT DOCUMENTS

| | | |
|---|---|---|
| 49-51951 | 5/1974 | Japan . |
| 54-110839 | 8/1979 | Japan . |
| 56-113146 | 9/1981 | Japan . |
| 1-204073 | 8/1989 | Japan . |

*Primary Examiner*—Roland Martin
*Attorney, Agent, or Firm*—Oliff & Berridge

[57] ABSTRACT

A developer for electrophotography which is excellent in the retention of the charge quantity of the toner and the controllability of the charge quantity, scarcely causes adhesion of the carrier to image areas and can provide stable image quality is disclosed, the developer comprising a toner containing a quaternary ammonium salt type charge control agent dispersed in a binder resin and a carrier coated with a resin comprising, as essential components, a vinylidene fluoride monomer unit-containing resin and a methylphenylsilicone resin.

6 Claims, No Drawings

DEVELOPER COMPOSITION FOR ELECTROPHOTOGRAPHY

CROSS-REFERENCE TO RELATED APPLICATION

This application is a continuation-in-art of application Ser. No. 07/836,385, filed Feb. 18, 1992, now U.S. Pat. No. 5,256,511.

FIELD OF THE INVENTION

The present invention relates to a developer composition comprising a carrier and a toner for magnetic brush development used in developing an electrostatic latent image in electrophotography, electrostatic recording, and the like.

BACKGROUND OF THE INVENTION

Recording systems for visualizing image information through an electrostatic latent image such as electrophotography are now widespread in various fields. In electrophotography, an electrophotographic photoreceptor is charged and then exposed to light to form an electrostatic latent image, the latent image is developed with a developer containing a toner, and the toner image is transferred and fixed to visualize the image. The developer used herein includes a two-component developer comprising a toner and a carrier, and a one-component developer comprising a toner, e.g., a magnetic toner alone. In the two-component developer, since a carrier bears such functions as agitation, delivery and charging of the developer, the two-component developer is characterized by satisfactory controllability and largely employed for the present time. In particular, developers using a resin-coated carrier are excellent in charge controllability and are relatively easy to improve environmental dependence and stability with time.

Development was formerly carried out by cascade development, but nowadays magnetic brush development using a magnetic roll as a developer carrier is dominant.

Magnetic brush development using a two-component developer has such disadvantages as reduction of image density and considerable background stain both due to reduction in charging properties of the developer, reduced image quality and consumption loss of the carrier both due to adhesion of the carrier onto the image, and occurrence of unevenness of image density. It is considered that the mechanism of adhesion of the carrier onto the image is such that with a reduction in resistance of the carrier, the induced charges are injected into the image areas, resulting in adhesion of the carrier to the image areas; or it is considered that charge quantity of the carrier after development becomes excessive on account of insufficient control of the upper limit of charge quantity of the carrier, resulting in adhesion of the carrier to the edges of the image areas.

In recent years, negatively chargeable organic photoreceptors have been spread, and reversal development in which an electrostatic latent image is formed by using laser, etc. has been frequently applied to inorganic photoreceptors. Accordingly, there has been increasing demands for high quality developers using a positively chargeable toner. Accordingly, it has been examined that various charge control agents are added to toners to stabilize the charge quantities of the toners at a proper value of positive charge, and further it has been extensively examined that the charging of the toners is controlled by choosing a resin with which the carrier is coated.

Quaternary ammonium salts are known as colorless high-safety charge control agents [see, JP-A-49-51951 (the term "JP-A" as used herein means an "unexamined published Japanese patent application")]. However, when the quaternary ammonium salt is used in the two-component developer using a positively chargeable toner, charge quantity is insufficient merely by adding a quaternary ammonium salt type charge control agent to a toner, and hence it is necessary to coat a carrier with a negatively chargeable resin.

In particular, fluorine-containing resins have been extensively studied as negatively chargeable resins for use in coating the carrier in recent years. However, there are problems that the fluorine-containing resins have poor adhesion to core particles and the coated layer thereof has poor abrasion resistance.

In order to improve adhesion of the fluorine containing resins to core particles, it has been proposed to coat the core particles with a mixture of a fluorine-containing resin and the second resin well compatible with the fluorine-containing resin, such as a methyl methacrylate copolymer as disclosed in JP-A-54-110839 and JP-A-56-113146. However, such a mixture system adversely affects such excellent properties as solid lubricating properties and low tackiness inherent in the fluorine-containing resins, resulting in interference with an improvement of the surface stain resistance of the carrier.

Further, a developer comprising a toner containing a quaternary ammonium salt type charge control agent and a carrier having a vinylidene fluoride copolymer-coated layer has been proposed as disclosed in JP-A-1-204073. However, the above-mentioned problems can not be solved, and it is difficult to freely control the charge quantity of the toner.

SUMMARY OF THE INVENTION

Accordingly, an object of the present invention is to provide a developer which is freed from the problems associated with the prior art as mentioned above, (1) which can stably retain the properly controlled charge quantity of a toner over a long period of time, (2) which can prevent a carrier from adhering to image areas and thereby from being largely consumed, whereby an image of stable quality can be formed, and (3) which can be applied to reversal development of high-quality organic or inorganic photoreceptors.

The present invention provides a developer for electrophotography, which comprises toner particles containing a positively chargeable charge control agent dispersed in a binder resin, and carrier particles having a resin material coated at least on the surfaces thereof, wherein said resin material comprises a vinylidene fluoride monomer unit-containing resin and a methylphenylsilicone resin.

DETAILED DESCRIPTION OF THE INVENTION

The vinylidene fluoride monomer unit-containing resin which is one component of the resin with which the carrier of the present invention is coated exhibits strongly negative chargeability to the quaternary ammonium salt type charge control agent, and the methylphenylsilicone resin which is another component of the coating resin exhibits very weak negative chargeability to the toner. Accordingly, the charge quantity of the toner and the electric resistance of the carrier can be arbitrarily controlled by adjusting the mixing ratio of both resins or the total amount of the coating resin. Further, since both resins are materials having low surface energy, a carrier having very excellent resistance to surface staining can be provided in comparison with conventional resin-coated carriers which are coated with a mixture of a fluorine-containing resin and an acrylic resin. Furthermore, the coating layer containing the methylphenylsilicone resin having a softening point of not lower than 50° C. according to the present invention is not so much brittle in comparison with conventional coating layers obtained from thermosetting resins, and has good compatibility with the fluorine-containing resin, and hence a coated carrier having good mechanical durability can be obtained.

Any of conventional quaternary ammonium salt type charge control agents can be used as the quaternary ammonium salt type charge control agent to be contained in the toner of the present invention. Specific examples of the quaternary ammonium salt type charge control agents are given below.

(1)

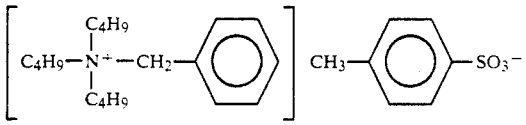

(2)

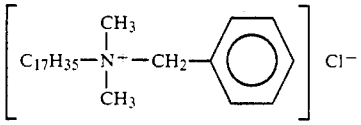

(3)

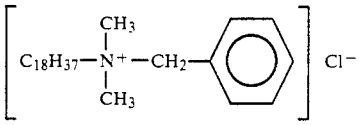

(4)

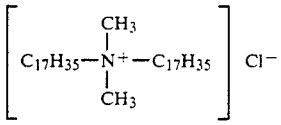

(5)

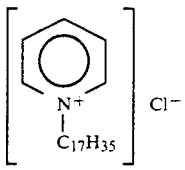

(6)

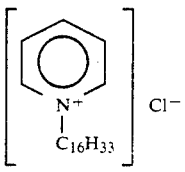

-continued (7)

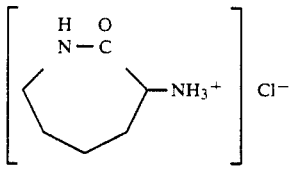

(8)

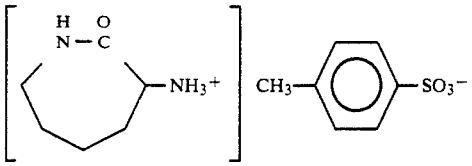

(9)

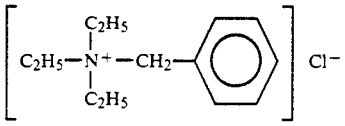

(10)

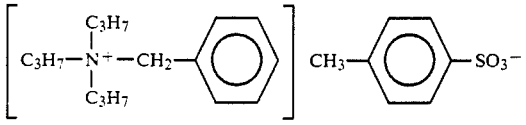

(11)

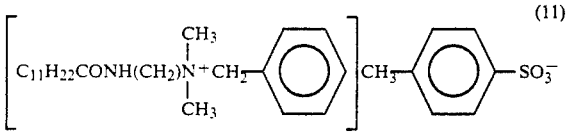

(12)

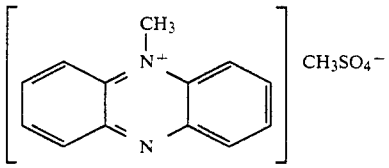

(12)

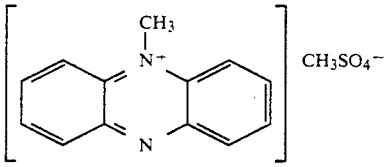

The charge control agent is added in an amount of preferably 0.1 to 10 parts by weight per 100 parts by weight of the binder resin of the toner in the present invention. When the amount of the charge control agent is less than 0.1 parts by weight, the charge rise-speed of the toner is insufficient, while when the amount is more than 10.0 parts by weight, the dispersion of the charge control agent in the toner is non-uniform and the distribution of the charge quantity of the toner becomes wider.

Examples of the binder resin used in the toner include homopolymers and copolymers of styrene or derivatives thereof (e.g., chlorostyrene), vinyl esters (e.g., vinyl acetate, vinyl propionate, vinyl benzoate and vinyl butyrate), α-methylene aliphatic monocarboxylic acid ester (e.g., methyl acrylate, ethyl acrylate, butyl acrylate, dodecyl acrylate, octyl acrylate, methyl methacrylate,ethyl methacrylate, butyl methacrylate and dodecyl methacrylate), vinyl ethers (e.g., vinyl methyl ether, vinyl ethyl ether and vinyl butyl ether), vinyl ketones (e.g., vinyl methyl ketone, vinyl hexyl ketone and vinyl isopropenyl ketone), and olefins. Particularly useful binder resins include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene and polypropylene. In addition, polyesters, polyurethanes, epoxy resins, silicone resins, polyamides, modified rosin and paraffin wax can also be used.

Examples of useful colorants used in the toner include carbon black, Aniline Blue, Charcoal Blue, Chrome Yellow, Ultramarine Blue, Du Pont Oil Red, Quinoline Yellow, Methylene Blue Chloride, Phthalocyanine Blue, Malachite Green oxalate, Lamp Black and Rose Bengale.

If desired, additives such as cleaning aid and fluidity accelerator may be added to the toner.

The toner particles of the present invention have an average particle size of about not larger than 30 μm, preferably from 3 to 20 μm.

The toner of the present invention may be in the form of a magnetic toner having a magnetic material encapsulated therein or a capsule toner containing a magnetic material therein.

Examples of the vinylidene fluoride monomer unit-containing resin which is one resin component of the coating resin with which the carrier of the present invention is coated include vinylidene fluoride homopolymers, vinylidene fluoride-tetrafluoroethylene copolymers, vinylidene fluoride-monofluoroethylene copolymers, vinylidene fluoride-trifluoroethylene copolymers, vinylidene fluoride-hexafluoropropylene copolymers, vinylidene fluoride-monochlorotrifluoroethylene copolymers and multi-component copolymers of vinylidene fluoride with these monomers.

The vinylidene fluoride unit content of the copolymer is not lower than 30 mol%, preferably not lower than 50 mol%. When the content is lower than 30 mol%, negative chargeability is lowered and the sufficient amount of charge can not be imparted to the toner.

The methylphenylsilicone resin having a softening point which is another resin component of the coating resin with which the carrier of the present invention is coated is used to retain the charge of the toner, ensure the degree of freedom of the control of the charge quantity and improve the strength of the coating layer of the carrier. Concretely, the methylphenylsilicone resin contains a unit derived from one or more members selected from the group consisting of monomers represented by the following general formulas (I), (II) and (III). It is preferred that the methylphenylsilicone resin has a softening point of not lower than 50° C. to prevent the fluidity of the carrier from being deteriorated in the apparatus under high temperature environmental conditions.

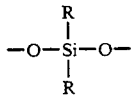
(I)

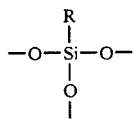
(II)

-continued

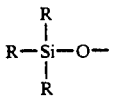
(III)

wherein R represents a methyl group or a phenyl group.

Since silicone polymers have generally some hydroxyl groups, the polymers are apt to be crosslinked by a dehydration reaction or an alcohol removal reaction when subjected to a heat treatment or a solvent removal treatment. Accordingly, besides showing no definite softening point, the silicone polymers have a high viscosity on heating and are therefore unsuitable for use in a process for coating the carrier wherein solvents are removed at a high temperature or a dry process for coating the carrier wherein core particles and coating resin particles are mixed with heating to thereby molten the resin particles thus forming a thin film. Accordingly, it is impossible to coat the carrier by the us of a polyblend thereof with a resin which requires a heat treatment at a high temperature, such as the vinylidene fluoride monomer unit-containing resin.

However, the present inventors have found that polymers having a relatively linear polymer structure comprising the above-described monomer units but primarily the unit of formula (I) and containing only a trace amount of hydroxyl group, have a definite softening point and show fluidity on heating and are therefore capable of overcoming the above-described problem and forming a good film to coat the carrier even when a polyblend thereof with the vinylidene fluoride monomer unit-containing resin is used. The term "definite softening point" as used herein means that when a heat absorption peak of the polymer is measured with a differential scanning calorimeter and the temperatures at the portions where each of the two inclined lines constituting the peak and the base line cross each other are measured, difference of the temperatures is not more than 30° C.

The coating resin is used in a total amount of 0.2 to 3.0% by weight based on the amount of the carrier. The mixing ratio (by weight) on the vinylidene fluoride monomer unit-containing resin to the methylphenylsilicone resin is preferably from 2:8 to 9:1 and more preferably from 5:5 to 9:1. When the amount of the vinylidene fluoride monomer unit containing resin is less than the lower limit defined above, a sufficient amount of positive charge may not be imparted to the toner, while when the amount is more than the upper limit defined above, an effect of adding the methylphenylsilicone resin may not be obtained.

Core particles used in the carrier of the present invention include powders of iron, ferrite and magnetite. The core particles have a particle size of usually about 30 to 200 μm.

The carrier of the present invention can be prepared by any of conventional solution coating methods such as spray drying method and immersion method or conventional dry coating methods wherein the core particles and the coating resin particles are dry-blended and the resulting blend is heated to melt them and cooled.

The thus-obtained developer composition of the present invention is used for developing an electrostatic latent image on a photoreceptor or an electrostatic recording medium. More specifically, in electrophotography, a latent image is electrophotographically formed on a photoreceptor comprising an inorganic photoconductive material, e.g., zinc oxide, cadmium sulfide or amorphous silicon, or an organic photoconductive material, e.g., a phthalocyanine pigment or a bisazo pigment. In electrostatic recording, a latent image is formed on an electrostatic recording medium having a dielectric substance, e.g., polyethylene terephthalate by the multistylus electrode. The thus formed electrostatic latent image is developed by a development method such as magnetic brush development or touch down development to a toner image. The toner image is transferred to a transfer material such as paper and then fixed to obtain a copied image or a print.

The present invention is now illustrated in greater detail with reference to Examples, but it should be understood that the present invention is not deemed to be limited thereto. The softening point of the methylphenylsilicone resin is a peak value as measured with a differential scanning calorimeter (DSC).

| Toner 1 | |
|---|---|
| Binder resin: styrene-n-butyl methacrylate (70/30) copolymer | 100 parts by weight |
| Carbon black (Reagal 330 manufactured by Cabot) | 10 parts by weight |
| Charge control agent: compound (2) | 3 parts by weight |
| Low-molecular weight polypropylene (Viscol 660 P manufactured by Sanyo Kasei KK) | 3 parts by weight |

The above components were melt-kneaded in a Banbury mixer, cooled and pulverized in a jet mill. The particles were classified by means of a classifier to obtain a toner having an average particle size of 11 μm.

Toner 2

A toner having an average particle size of 11 μm was prepared in the same manner as in the preparation of the toner 1 except that compound (3) was used as the charge control agent.

| Toner 3 | |
|---|---|
| Binder resin: styrene-n-butyl acrylate (80/20) copolymer | 100 parts by weight |
| Carbon black (Reagal 330 manufactured by Cabot) | 10 parts by weight |
| Charge control agent: compound (2) | 6 parts by weight |
| Low-molecular weight polypropylene (Viscol 660 P manufactured by Sanyo Kasei KK) | 4 parts by weight |

In the same manner as in the preparation of the toner 1, a toner having an average particle size of 11 μm was prepared from the above components.

Toner 4

A toner having an average particle size of 11 μm was prepared in the same manner as in the preparation of the toner 3 except that compound (11) was used as the charge control agent.

Toner 5

A toner having an average particle size of 11 μm prepared in the same manner as in the preparation of the toner 1 except that the charge control agent was omitted.

Toner 6

A toner having an average particle size of 11 μm was prepared in the same manner as in the preparation of the toner 3 except that Bontron N-03 (nigrosine dye manufactured by Orient Kagaku KK) was used as the charge control agent.

Carrier 1

A solution of 7 parts by weight of a vinylidene fluoride-hexafluoropropylene copolymer (88/12) (KF 2000 manufactured by Kureha Chemical Industry Co., Ltd.) and 5 parts by weight of a methylphenylsilicone resin having a softening point of 100° C. (M 9110 manufactured by Toray Dow Corning silicone) dissolved in 100 part by weight of dimethylformamide was added to 1,000 parts by weight of spherical ferrite particles having an average particle size of 80 μm. The mixture was mixed in a vacuum kneader equipped with a heating jacket at room temperature for 2 minutes. Subsequently, hot water was allowed to circulate through the jacket to set the temperature on the wall surface of the kneader to 100° C. The mixture was then stirred under a reduced pressure of 360 mmHg for 20 minutes. Further, the pressure was reduced to 10 mmHg and the mixture was stirred for 30 minutes to dry and remove completely the solvent. The product was taken out from the kneader, followed by screening using a sieve of 150 μm to obtain a carrier.

Carrier 2

A solution of 12 parts by weight of polyvinylidene fluoride (KYNAR 201 manufactured by Pennwalt Co., Ltd.) and 3 parts by weight of a methylphenylsilicone resin having a softening point of 70° C. (M 9080 manufactured by Toray Dow Corning Silicone) dissolved in 100 parts by weight of dimethylformamide was added to 1,000 parts by weight of spherical ferrite particles having an average particle size of 60 μm. In the same manner as in the preparation of the carrier 1, a coating treatment was then carried out to obtain a carrier.

Carrier 3

Fifteen parts by weight of a vinylidene fluoridetetrafluoroethylene copolymer (80/20) (KYNAR 7201 manufactured by Pennwalt Co., Ltd.) and 5 parts by weight of a methylphenylsilicone resin having a softening point of 100° C. (M 9110 manufactured by Toray Dow Corning Silicone) were added to 1,000 parts by weight of spherical ferrite particles having an average particle size of 65 μm. The mixture was dry-blended in a batch kneader equipped with a heating jacket for 10 minutes. Subsequently, the blend was kneaded with stirring for 30 minutes while circulating a heating medium of 200° C. through the jacket. Thereafter, the circulation of the heating medium was stopped, and the mixture was stirred for 40 minutes while cooling. The product was taken out from the kneader, followed by screening using a sieve of 149 μm to obtain a carrier.

Carrier 4

A carrier was prepared in the same manner as in the preparation of the carrier 1 except that the methylphenylsilicone resin was omitted.

Carrier 5

A carrier was prepared in the same manner as in the preparation of the carrier 3 except that 3 parts by weight of the vinylidene fluoride-tetrafluoroethylene copolymer (KYNAR 7201) and 17 parts by weight of the methylphenylsilicone resin were used.

Preparation of developer

The above toners and carriers in combination indicated below were mixed in such an amount as to give a toner concentration of 4%.

Test by practically using them in a copying machine

The developers of Examples 1 to 4 and Comparative Examples 1 and 2 were tested for image quality retention by using a copying machine VIACE 500 (normal development system using an organic photoreceptor) manufactured by Fuji Xerox Co., Ltd. The developers of Examples 5 to 8 and Comparative Examples 3 to 6 were tested for image quality retention by using a copying machine (FX 6790 Modified Model (reversal development system using an inorganic photoreceptor]-manufactured by Fuji Xerox Co., Ltd.). The results obtained are shown in Tables 1 and 2.

TABLE 1

| Example No. | Toner | Carrier | Initial charge quantity | Charge quantity after 200,000 copies | Initial image quality | Image quality after 200,000 copies | Remarks |
|---|---|---|---|---|---|---|---|
| Ex. 1 | 1 | 1 | 22 | 18 | no problem | no problem | Good image quality retention |
| Ex. 2 | 2 | 1 | 20 | 16 | no problem | no problem | Good image quality retention |
| Ex. 3 | 3 | 2 | 23 | 20 | no problem | no problem | Good image quality retention |
| Ex. 4 | 4 | 3 | 25 | 24 | no problem | no problem | Good image quality retention |
| Comp. Ex. 1 | 5 | 3 | 9 | 15 | unevenness in density, fog over the whole surface | unevenness in density | Initial image quality was bad |
| Comp. Ex. 2 | 6 | 2 | 31 | 12 | somewhat low density | unevenness in density | Image quality became bad after about 80,000 copies |

TABLE 2

| Example No. | Toner | Carrier | Initial charge quantity | Charge quantity after 200,000 copies | Initial image quality | Image quality after 200,000 copies | Remarks |
|---|---|---|---|---|---|---|---|
| Ex. 5 | 1 | 1 | 22 | 20 | no problem | no problem | Good image quality retention |
| Ex. 6 | 1 | 2 | 18 | 10 | no problem | no problem | Good image quality retention |
| Ex. 7 | 3 | 3 | 23 | 21 | no problem | no problem | Good image quality retention |
| Ex. 8 | 3 | 1 | 21 | 19 | no problem | no problem | Good image quality retention |
| Comp. Ex. 3 | 2 | 4 | 26 | 10 | no problem | unevenness in density | Image quality became bad after about 100,000 copies |
| Comp. Ex. 4 | 5 | 2 | 12 | 10 | Fog occurred | Fog occurred | Initial image quality was bad |
| Comp. Ex. 5 | 6 | 3 | 30 | 11 | no problem | unevenness in density | Image quality became bad after about 120,000 copies |
| Comp. Ex. 6 | 6 | 5 | 17 | 6 | no problem | low density, fog over the whole surface | Image quality became bad after about 70,000 copies |

As is apparent from the results of Tables 1 and 2, the developers according to the present invention enable the charge quantity of the toner to be retained over a long period of time, can provide image quality at a high density without causing unevenness in density or fog, and do not cause adhesion of the carrier to image areas.

While the invention has been described in detail and with reference to specific examples thereof, it will be apparent to one skilled in the art that various changes and modifications can be made therein without departing from the spirit and scope thereof.

What is claimed is:

1. A developer for electrophotography, which comprises toner particles containing a positive chargeable charge control agent dispersed in a binder resin and carrier particles having a resin material coated at least one the surfaces thereof, wherein said resin material comprises a vinylidene fluoride monomer unit-containing resin and a methylphenylsilicone resin, wherein said carrier particles have a negative triboelectric charge with respect to the toner particles.

2. A developer for electrophotography as claimed in claim 1, wherein said methylphenylsilicone resin has a softening point.

3. A developer for electrophotography as claimed in claim 2, wherein said softening point is not lower than 50° C.

4. A developer for electrophotography as claimed in claim 1, wherein said vinylidene fluoride monomer unit-containing resin and said methylphenylsilicone resin are mixed in a ratio of from 2:8 to 9:1.

5. A developer for electrophotography as claimed in claim 4, wherein said vinylidene fluoride monomer unit-containing resin and the methylphenylsilicone resin are mixed in a ratio of from 5:5 to 9:1.

6. A developer for electrophotography as claimed in claim 1, wherein said positive chargeable charge control agent is a quaternary ammonium salt type charge control agent.

* * * * *